US005544401A

United States Patent [19]

Danino

[11] Patent Number: 5,544,401

[45] Date of Patent: Aug. 13, 1996

[54] RIVETING DEVICE

[76] Inventor: Avraham Danino, 8 Granados St., Ramatgan 52326, Israel

[21] Appl. No.: 427,202

[22] Filed: Apr. 21, 1995

[30] Foreign Application Priority Data

Jan. 2, 1995 [IL] Israel ..... 112214

[51] Int. Cl.[6] ..... B21J 15/26

[52] U.S. Cl. ..... 29/243.526

[58] Field of Search ..... 29/243.526, 243.521; 72/391.8, 391.4

[56] References Cited

U.S. PATENT DOCUMENTS

| | | | |
|---|---|---|---|
| 3,626,745 | 12/1971 | Richardson et al. | 29/243.526 |
| 3,906,775 | 9/1975 | Benimetzki | 29/243.526 |
| 4,063,443 | 12/1977 | Yarbrough | 29/243.526 |

*Primary Examiner*—David Jones

[57] ABSTRACT

A power-operated riveting tool which includes a unidirectional rotational power source having a rotational output along a rotation axis; and a power-driven riveting attachment for mounting onto the rotational power source, wherein the riveting attachment includes rivet holding and pulling apparatus mounted for axial translation along a work axis between extended and retracted positions, the rivet holding and pulling apparatus having a rearwardly extending threaded shank integrally formed therewith, the rivet holding and pulling apparatus being restrained from rotation about the work axis; transmission apparatus for selectable operation by the rotational power source, and threadedly engaged with the threaded shank along the axis, operation of the rotational power source causing rotation of the transmission apparatus about the work axis in a first direction, thereby to cause a linear translation of the threaded shank and thus the rivet holding and pulling apparatus along the work axis in a corresponding first axial direction, from the extended to the retracted position; and windable resilient return apparatus associated with the transmission apparatus and which, when the rotational power source is operated so as to rotate the transmission apparatus, is operative to be wound, and which, when the transmission apparatus is disengaged from the rotational power source, is operative to rotate the transmission apparatus in a second, reverse direction, thereby to cause a corresponding linear translation of the rivet holding and pulling apparatus in a second axial direction, thereby to return the rivet holding and pulling apparatus from the retracted to the extended position.

15 Claims, 2 Drawing Sheets

RIVETING DEVICE

FIELD OF THE INVENTION

The present invention relates to power tools, in general, and to riveting tools, in particular.

BACKGROUND OF THE INVENTION

In Israel U.S. Pat. No. 58534, registered to the present Applicant, there is described a multi-purpose tool having a two-directional motor, the tool being destined for a variety of operations, including installation of rivets, nuts, screws and the like. The tool consists of a two-directional rotational power source, to which may be coupled an attachment which consists of tool head, such as a conventional rivet placing head, which is mounted for axial translation along a work axis. The tool head has an axially extending externally threaded cylindrical shank which threadedly engages an internal, axially extending screw thread formed in a spindle. The spindle, tool head, and power source, are all located along the work axis. The spindle member is drivingly couplable to the rotational power source via a clutch mechanism. The tool head, spindle member and clutch mechanism are mounted within a housing which is mounted, via a screw mounting, onto the power source.

Operation of the power source when the clutch is engaged therewith causes rotation of the spindle inside the housing. This rotation is operative to drive the tool head, via its threaded shank, along the work axis. Operation of the rotational power source in one direction causes engagement of the tool head with a work piece, while operation of the power source in the opposite direction causes retraction and disengagement of the tool head therefrom.

SUMMARY OF THE INVENTION

The present invention seeks to provide a power operated riveting tool which requires a unidirectional motor only, and which does not require a clutch such as in the prior art.

The present invention further seeks to provide a power operated riveting attachment which may be mounted onto a commonly available unidirectional motive source, such as a power drill.

The present invention further seeks to provide a dual purpose drill and riveting tool.

There is thus provided, in accordance with a preferred embodiment of the invention, a power-operated riveting tool which includes:

a unidirectional rotational power source having a rotational output along a rotation axis; and a power-driven riveting attachment for mounting onto the rotational power source, which includes rivet holding and pulling apparatus mounted for axial translation along a work axis between extended and retracted positions, the rivet holding and pulling apparatus having a rearwardly extending threaded shank integrally formed therewith, the rivet holding and pulling apparatus being restrained from rotation about the work axis;

transmission apparatus for selectable operation by the rotational power source, and threadedly engaged with the threaded shank along the axis, operation of the rotational power source causing rotation of the transmission apparatus about the work axis in a first direction, thereby to cause a linear translation of the threaded shank and thus the rivet holding and pulling apparatus along the work axis in a corresponding first axial direction, from the extended to the retracted position; and windable resilient return apparatus associated with the transmission apparatus and which, when the rotational power source is operated so as to rotate the transmission apparatus, is operative to be wound, and which, when the transmission apparatus is disengaged from the rotational power source, is operative to rotate the transmission apparatus in a second, reverse direction, thereby to cause a corresponding linear translation of the rivet holding and pulling apparatus in a second axial direction, thereby to return the rivet holding and pulling apparatus from the retracted to the extended position.

In accordance with a further embodiment of the invention, the power source is a drill, typically electrical or pneumatic, and the threaded shank has a drill piece receiving bore, thereby to permit mounting of the attachment onto the drill wherein the drill piece is inserted into the bore, whereby the drill functions as a dual purpose tool operative, in a first mode of operation, to drill a hole in a work piece sought to receive a rivet, and further operative in a second work mode, to drive the attachment, thereby to hold and pull a rivet through the hole in the work piece.

BRIEF DESCRIPTION OF THE DRAWINGS

The present invention will be more fully understood and appreciated from the following detailed description, taken in conjunction with the drawings, in which.

DETAILED DESCRIPTION OF A PREFERRED EMBODIMENT

Figure 1:
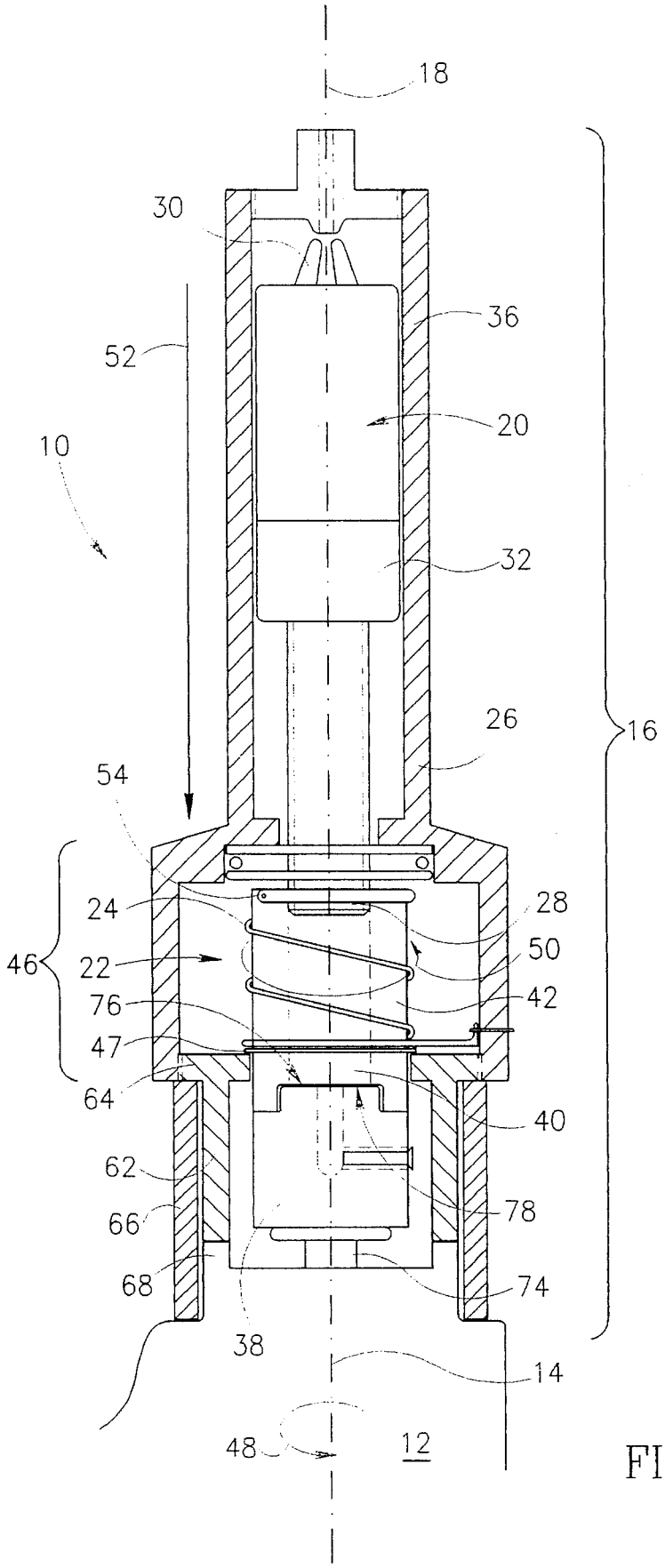
FIG. 1 is a part-sectional side view illustration of a tool constructed and operative in accordance with a preferred embodiment of the present invention in an extended position.
Figure 2:
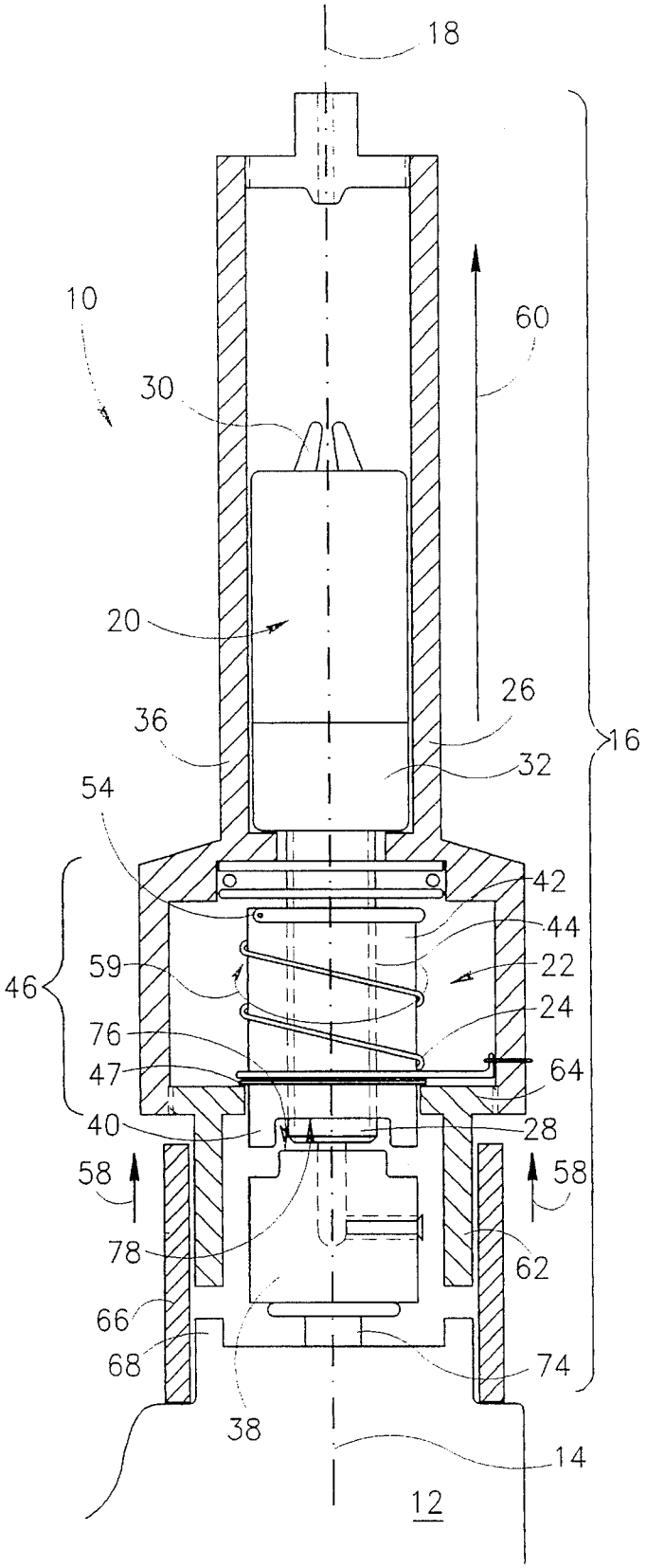
FIG. 2 is an illustration similar to FIG. 1 but showing the riveting tool in a retracted position.

Referring now to FIGS. 1 and 2, there is seen a power-operated riveting tool, referenced generally 10, constructed an operative in accordance with a preferred embodiment of the present invention.

Riveting tool 10 has two main portions, namely, a unidirectional rotational power source 12 (shown also in FIG. 3), having a rotational output along a rotation axis 14; and a riveting attachment, referenced generally 16, which defines a work axis 18. Attachment 16 is adapted for mounting onto the power source 12 such that rotation axis 14 and work axis 18 are in colinear registration.

Riveting attachment 16 includes a rivet holding and pulling head 20, transmission apparatus 22, and a windable resilient return element 24, housed within a housing 26.

Figure 3:
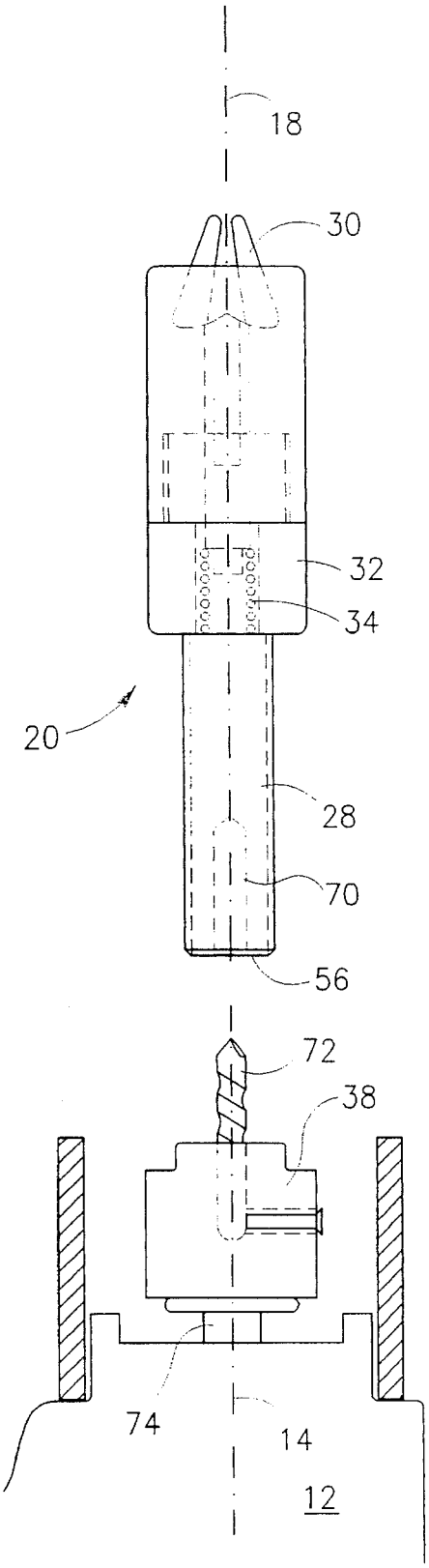
FIG. 3 is a schematic side view exploded illustration showing the rivet holding and pulling head of the tool of the invention and the power source therefor.

Referring now also to FIG. 3, rivet holding and pulling head 20 is mounted for axial translation along work axis 18 between an extended position, seen in FIG. 1, and a retracted position, seen in FIG. 2. Rivet holding and pulling head 20 has a rivet holding chuck and pulling member 30 which is attached to a collet nut 32 housing an ejection spring 34 for a rivet (not shown), all as known, per se. A portion of the rivet holding and pulling head 20, preferably the collet nut 32, and a forward portion 36 of housing 26 typically have similar non-circular cross-sectional shapes, such that the rivet holding and pulling head is restrained from rotation about the work axis 18, while being free to move therealong. A rear portion of the rivet holding and pulling head 20 has formed thereon a rearwardly extending threaded shank 28.

Transmission apparatus 22 is adapted for selectable driven engagement with a chuck 38 of the rotational power source 12 via a coupling portion 40, as described hereinbelow in detail. Transmission apparatus further comprises a spindle 42, preferably formed integrally with coupling portion 40. Spindle 42 has an internal screw thread 44 which is adapted for threaded engagement with the threaded shank 28 along the work axis 18. Spindle 42 is located within a lower portion 46 of housing 26 and is restrained, both by housing portion 46 and by a locking element 47, from movement along work axis 18, while being free to rotate thereabout.

It will thus be appreciated that, when coupling portion 40 is engaged with chuck 38, as seen in FIG. 1, operation of the rotational power source 12 causes rotation of the transmission apparatus 22 about the work axis 18 in a first direction. This rotation is indicated by an arrow 48 in FIG. 1. Rotation of spindle 42 as indicated by arrow 50, causes a corresponding linear translation of the threaded shank 28 and thus the entire rivet holding and pulling head 20 along the work axis 18 in a first axial direction, as indicated by arrow 52, from the extended position seen in FIG. 1 to the retracted position seen in FIG. 2.

Among advantages of the present invention over the prior art is that power source 12 need be only a unidirectional power source, such as an electric or pneumatic drill, for example, having a removable chuck, and further, that no clutch mechanism is required. These advantages are facilitated by the provision of return element 24, as described below.

Return element 24 is typically a rotational spring that, in the illustrated embodiment, is wound about spindle 42. A first end 54 of spring 24 is attached to a forward portion of spindle 42, while a second end of the spring 24 is attached to a rear portion of lower portion 46 of housing 26.

It will thus be appreciated that, when transmission apparatus 22 is rotated, as shown in FIG. 1, spring 24 is wound about spindle 42, so as to be tensioned. Continued rotation of spindle 42 causes complete retraction of the threaded shank 28 through the spindle 42, such that a free end 56 of the shank 28 engages a forward surface 76 of chuck 38 so as to push thereagainst. As the shank 28 continues to be drawn through the spindle 42, the pushing of shank 28 against chuck 38 causes the housing 26, including coupling portion 40, to move away and become decoupled from chuck 38. This is indicated in FIG. 2 by arrows 58.

Once coupling portion 40 has become decoupled from chuck 38, spring 24 is permitted to unwind, thereby rotating the transmission apparatus 22 in reverse, as indicated by arrow 59. This causes a reverse linear translation of the rivet holding and pulling head 20 along work axis 18, as indicated by an arrow 60, thereby to return the rivet holding and pulling head 20 from the retracted position seen in FIG. 2, to the extended position seen in FIG. 1.

In accordance with a preferred embodiment, power source 12 is an electric or pneumatic drill. Housing 26 is mounted onto the drill via a rearwardly extending first collar member 62 formed onto a rear portion 64 of the housing 26, and a forwardly extending second collar member 66 configured for mounting onto the drill. As seen, the first and second collar members 62 and 66 are formed so as to fit one inside the other. Furthermore, the respective axial lengths of the collar members are predetermined so as to permit support of the first collar member 62 on a casing portion 68 of the power tool 10, and so as also to permit support of the rear portion 64 of the housing 26 onto the second collar member 66.

According to a preferred embodiment of the invention, and as seen most clearly in FIG. 3, shank 28 has an axial bore 70 formed therein and there is provided an elongate member 72, mounted in chuck 38 and adapted for insertion into bore 70, thereby maintaining accurate coaxial registration of rotation axis 14 and work axis 18. Typically, elongate member 72 is an appropriate size drill piece.

In accordance with a preferred embodiment of the invention, drill piece 72 is the same size as the hole in which it is desired to place a rivet by means of the present invention. It will thus be appreciated that, due to the simplicity with which attachment 16 can be slipped on and off the drill, the drill effectively operates as a dual purpose tool; first, for drilling a hole; and second, for placing a rivet in the hole.

As seen in FIGS. 1 and 2, and as described above, coupling portion 40 is configured for selectable locking engagement with the chuck 38. Preferably, chuck 38 replaces the original drill chuck and is adapted for mounting directly onto the drill spindle 74. Accordingly, a front face portion 76 of chuck 38 and a rear portion 78 of coupling portion 40 are adapted for keying into each other, such that no relative rotation is permitted therebetween about work axis 18. Clutch 40 and chuck 38 may have any suitably configured interface, typically having being any square or polygonal shape male-female keying assembly. According to an alternative embodiment of the invention, however, while chuck 38 may be the original drill chuck, a rear portion 78 of coupling portion 40 being configured accordingly, for keying into front face portion 76 of the chuck.

It will be appreciated by persons skilled in the art that the scope of the present invention is not limited to what has been particularly shown and described hereinabove, merely by way of example. Rather, the scope of the present invention is limited solely by the claims, which follow.

What is claimed is:

1. A power-driven riveting attachment for mounting onto a unidirectional rotational power source having a rotational output along a rotation axis, said attachment comprising:

rivet holding and pulling means mounted for axial translation along a work axis between extended and retracted positions, said rivet holding and pulling means having a rearwardly extending threaded shank integrally formed therewith, said rivet holding and pulling means being restrained from rotation about said work axis;

transmission means for selectable operation by the rotational power source, and threadedly engaged with said threaded shank along said axis, operation of the rotational power source causing rotation of said transmission means about said work axis in a first direction, thereby to cause a linear translation of said threaded shank and thus said rivet holding and pulling means along said work axis in a corresponding first axial direction, from the extended to the retracted position; and windable resilient return means associated with said transmission means and which, when the rotational power source is operated so as to rotate said transmission means, is operative to be wound, and which, when said transmission means is disengaged from the rotational power source, is operative to rotate said transmission means in a second, reverse direction, thereby to cause a corresponding linear translation of said rivet holding and pulling means in a second axial direction, thereby to return said rivet holding and pulling means from the retracted to the extended position;

and wherein said transmission means comprises:

a cylindrical spindle restrained against linear translation along said work axis and having formed therein an internal screw thread for threaded engagement with said threaded shank; and coupling means having a first portion associated with said spindle and a second portion associated with said power source and couplable to said first portion, wherein coupling of said first and second portions of said coupling means is operative to couple the rotational power source to said spindle, thereby to cause rotation thereof.

2. An attachment according to claim 1, and wherein said threaded shank has a rear end portion that protrudes rearwardly through said spindle when said rivet holding and pulling means is in a retracted position thereby to push against said second portion of said coupling means and thereby to cause mutual decoupling of said first and second portions so as also to cause decoupling of said spindle and thus said attachment from the power source;

said decoupling permitting unwinding of said return means thereby to cause said rotation of said spindle in said second, reverse direction, thereby to cause said return said rivet holding and pulling means from the retracted to the extended position.

3. An attachment according to claim 1, and wherein said rotational power source is a rotational power tool, and said attachment also includes:

a housing in which said rivet holding and pulling means, transmission means and return means are housed; and means for mounting said housing onto the power tool.

4. An attachment according to claim 3, and wherein said means for mounting comprises:

a rearwardly extending first collar member formed onto a rear portion of said housing; and a forwardly extending second collar member configured for mounting onto the power tool, wherein said first and second collar members are formed so as to fit one inside the other, and wherein the respective axial lengths of the said first and second collar members are predetermined so as to permit support of said first collar member on a portion of the power tool, and so as also to permit support of said rear portion of said housing onto said second collar member.

5. An attachment according to claim 4, and wherein the rotational power source provides a rotational output along a rotation axis, and said attachment also includes registration means for bringing said work axis into registration with the rotation axis, and for maintaining said registration.

6. An attachment according to claim 5, and also including a chuck mounted onto the power tool in coaxial alignment with the rotation axis, and wherein said shank has an axial bore formed therein and said registration means comprises an elongate member mounted in said chuck and said axial bore.

7. An attachment according to claim 1, and wherein the rotational power source is a drill having a spindle power output, and said attachment also comprises a chuck for mounting directly onto the drill spindle, and having a front portion configured for keying engagement with said coupling means.

8. A power-operated riveting tool which comprises:

a unidirectional rotational power source having a rotational output along a rotation axis; and a power-driven riveting attachment for mounting onto said rotational power source, said attachment comprising:

rivet holding and pulling means mounted for axial translation along a work axis between extended and retracted positions, said rivet holding and pulling means having a rearwardly extending threaded shank integrally formed therewith, said rivet holding and pulling means being restrained from rotation about said work axis;

transmission means for selectable operation by said rotational power source, and threadedly engaged with said threaded shank along said axis, operation of said rotational power source causing rotation of said transmission means about said work axis in a first direction, thereby to cause a linear translation of said threaded shank and thus said rivet holding and pulling means along said work axis in a corresponding first axial direction, from the extended to the retracted position; and windable resilient return means associated with said transmission means and which, when said rotational power source is operated so as to rotate said transmission means, is operative to be wound, and which, when said transmission means is disengaged from said rotational power source, is operative to rotate said transmission means in a second, reverse direction, thereby to cause a corresponding linear translation of said rivet holding and pulling means in a second axial direction, thereby to return said rivet holding and pulling means from the retracted to the extended position;

and wherein said transmission means comprises:

a cylindrical spindle restrained against linear translation along said work axis and having formed therein an internal screw thread for threaded engagement with said threaded shank; and coupling means having a first portion associated with said spindle and a second portion associated with said power source and couplable to said first portion, wherein coupling of said first and second portions of said coupling means is operative to couple said rotational power source to said spindle, thereby to cause rotation thereof.

9. A riveting tool according to claim 8, and wherein said threaded shank has a rear end portion that protrudes rearwardly through said spindle when said rivet holding and pulling means is in a retracted position thereby to push against said second portion of said coupling means and thereby to cause mutual decoupling of said first and second portions so as also to cause decoupling of said spindle and thus said attachment from said power source;

said decoupling permitting unwinding of said return means thereby to cause said rotation of said spindle in said second, reverse direction, thereby to cause said return said rivet holding and pulling means from the retracted to the extended position.

10. A riveting tool according to claim 8, and wherein said rotational power source is a rotational power tool, and said attachment also includes:

a housing in which said rivet holding and pulling means, transmission means and return means are housed; and means for mounting said housing onto said power tool.

11. A riveting tool according to claim 10, and wherein said means for mounting comprises:

a rearwardly extending first collar member formed onto a rear portion of said housing; and a forwardly extending second collar member configured for mounting onto said power tool, wherein said first and second collar members are formed so as to fit one inside the other, and wherein the respective axial lengths of the said first and second collar members are predetermined so as to permit support of said first collar member on a portion of said power tool, and so as also to permit support of said rear portion of said housing onto said second collar member.

12. A riveting tool according to claim 11, and wherein said rotational power source provides a rotational output along a rotation axis, and said attachment also includes registration means for bringing said work axis into registration with the rotation axis, and for maintaining said registration.

13. A riveting tool according to claim 12, and also including a chuck mounted onto said power tool in coaxial alignment with the rotation axis, and wherein said shank has an axial bore formed therein and said registration means comprises an elongate member mounted in said chuck and said axial bore.

14. A riveting tool according to claim 8, and wherein said rotational power source is a drill having a spindle power output, and said attachment also comprises a chuck for mounting directly onto the drill spindle, and having a front portion configured for keying engagement with said coupling means.

15. A riveting tool according to claim 8, and wherein said power source is a drill, and wherein said threaded shank has a drill piece receiving bore, thereby to permit mounting of said attachment onto said drill wherein said drill piece is inserted into said bore, whereby said drill functions as a dual purpose tool operative, in a first mode of operation, to drill a hole in a work piece sought to receive a rivet, and further operative in a second work mode, to drive said attachment, thereby to hold and pull a rivet through the hole in the work piece.

* * * * *